US007007529B2

(12) United States Patent
Futamura et al.

(10) Patent No.: US 7,007,529 B2
(45) Date of Patent: Mar. 7, 2006

(54) PRESSING MACHINE

(75) Inventors: Shoji Futamura, Kawasaki (JP); Keizo Unno, Tokyo (JP)

(73) Assignee: Institute of Technology Precision Electrical Discharge Work's, Kanagawa (JP)

( * ) Notice: Subject to any disclaimer, the term of this patent is extended or adjusted under 35 U.S.C. 154(b) by 38 days.

(21) Appl. No.: 10/499,603

(22) PCT Filed: May 12, 2003

(86) PCT No.: PCT/JP03/05878

§ 371 (c)(1),
(2), (4) Date: Jun. 16, 2004

(87) PCT Pub. No.: WO03/097338

PCT Pub. Date: Nov. 27, 2003

(65) Prior Publication Data

US 2005/0039510 A1 Feb. 24, 2005

(30) Foreign Application Priority Data

May 17, 2002 (JP) ..... 2002-142263

(51) Int. Cl.
*B21J 9/20* (2006.01)

(52) U.S. Cl. ..... 72/20.1; 72/20.1; 72/21.3; 72/30.1; 72/31.01; 72/453.08; 100/46; 100/257; 100/348

(58) Field of Classification Search ..... 72/21.3, 72/30.1, 31.01, 453.08; 100/257, 348, 46
See application file for complete search history.

(56) References Cited

U.S. PATENT DOCUMENTS

| | | | | | |
|---|---|---|---|---|---|
| 4,480,538 | A | * | 11/1984 | Yoshida | 100/48 |
| 4,828,474 | A | * | 5/1989 | Ballantyne | 425/150 |
| 5,471,856 | A | * | 12/1995 | Suzuki et al. | 72/1 |
| 2002/0170337 | A1 | | 11/2002 | Futamura et al. | |

FOREIGN PATENT DOCUMENTS

| | | |
|---|---|---|
| JP | 06-284630 | 10/1994 |
| JP | 11-254191 | 9/1999 |
| JP | 2000-343283 | 12/2000 |
| JP | 2002-239800 | 8/2002 |
| JP | 2002-263900 | 9/2002 |

* cited by examiner

*Primary Examiner*—Derris H. Banks
*Assistant Examiner*—Teresa M. Bonk
(74) *Attorney, Agent, or Firm*—McGlew & Tuttle, P.C.

(57) ABSTRACT

A press forming machine having a slide plate which reciprocates by driving sources between a lower support stand and an upper support plate and has a forming space between the lower support stand and the slide plate. In the press forming machine, a reference plate for a displacement reference for the slide plate is supported on the lower support stand. The driving sources are engaged with the slide plate by the drive shafts of the driving sources to drive and press the slide plate. The drive shaft is provided with a through hole axially extending in a shaft center thereof, and displacement measuring devices each for each of the drive shafts measures the displacement of the slide plate portion corresponding to the through hole with respect to the reference plate, through the through hole. As a result, the displacements at the pressurized points on the slide plate can be measured.

3 Claims, 7 Drawing Sheets

PRESSING MACHINE

TECHNICAL FIELD

The present invention relates to a press forming machine used for forming a metallic plate and the like, and particularly relates to a press forming machine which makes it possible to measure a position of a slide plate mounted with a movable die accurately with respect to a stationary die mounted to a support stand.

BACKGROUND ART

Press forming machines are used for punching press, wire drawing, die forging, injection molding and the like. A press forming machine having a stationary die and a movable die is generally used. A vertical press forming machine has a lower support stand, a plurality of support pillars supported at the lower support stand, an upper support plate held by the support pillars, and a slide plate capable of reciprocating along the support pillars between the lower support stand and the upper support plate and having a forming space between the lower support stand and itself. In the forming space, a stationary die is provided on the lower support stand, a movable die is provided on an undersurface of the slide plate, and a work piece is formed between the stationary die and the movable die. The slide plate is normally in a plane form, and is moved up and down by a drive mechanism. It is desirable to carry out forming by moving the movable die while keeping the movable die in desired positional relationship with respect to the stationary die, for example, while keeping the movable die horizontal.

Depending on the shape of a work piece subjected to press forming, an offset load occurs to the dies, and the positional relationship of the stationary die and the movable die or the slide plate is not maintained horizontal. It is proposed to keep the slide plate horizontal by controlling driving forces from the driving sources to keep synchronism among a plurality of driving sources, when a plurality of driving sources for driving the slide plate are installed in a press forming machine.

However, the work piece formed by press forming has a complicated shape such as a three-dimensional shape, and therefore not only the magnitude of the force exerted on the slide plate during forming changes with the proceeding of the forming, but also the location on which the force is exerted moves with the forming.

Reaction forces exerted on the slide plate are schematically shown in FIGS. 7A, 7B and 7C, for example, when draw forming for an oil pan for an automobile is performed. A slide plate 40 is shown as the x and y coordinates in each of the drawings. For example, when forming is started, the upper die first reaches the drainage portion of the oil pan to form the drainage portion, and therefore the force generated at the portion is applied on the fourth quadrant of the x and y coordinates. When the forming proceeds, the oil pan portion is formed, and the slide plate receives the large forces w2 and w3 from the second quadrant and the third quadrant of the coordinates. At this time, the force of w1 existing from the beginning becomes small, and since the large force w4 of the first quadrant is added, the composite force W of them is applied on the third quadrant. When the forming further proceeds, the forces w2 to w4 become small and the force w5 is added, then the composite force is approximately on the x-axis and works to the right from the y-axis.

The way how the forces and the composite force explained here are exerted, the magnitude of the forces and the composite force explained here will change depending on the shape of the work piece and the speed at which the dies move, but it can be generally said that the location and the magnitude of the composite force worked on the slide plate change as the pressing proceeds.

The inventors have proposed a press forming machine which makes a slide plate keep preferable positional relationship with respect to a lower support stand throughout press forming. In the press forming machine, the slide plate is driven and pressurized by a plurality of driving sources, and displacement measuring devices for measuring displacement of the slide plate are provided near the portion where each of the driving sources engages with the slide plate. The displacement of the slide plate is measured with the displacement measuring devices at each stage of the press forming, and a driving signal is supplied to each of the driving sources so that preferable positional relationship of the slide plate with respect to the lower support stand can be maintained.

The press forming machine is shown in the front view in FIG. 5, and in the plan view in FIG. 6. In FIG. 6, the upper support plate is shown with part of it being removed. A lower support stand 10 of the press forming machine is fixed on a floor surface, and an upper support plate 30 is held by support pillars 20 placed upright on the lower support stand. A slide plate 40 capable of reciprocating along the support pillars 20 is provided between the lower support stand 10 and the upper support plate 30, and the forming space is provided between the slide plate and the lower support stand. In the forming space, a stationary die (lower die) for pressing is mounted on the lower support stand, a movable die (upper die) corresponding to the stationary die is mounted on the undersurface of the slide plate, and for example, a plate to be formed is placed between the both dies to perform forming.

Five components each combining a servomotor and a speed reduction mechanism are mounted on the upper support plate 30 as drive sources 70. The drive shaft 71 extending downward from each of the driving sources engages with each engaging portion 72 on a top surface of the slide plate 40 through a through hole 92' provided in a reference plate 90'. For example, a ball screw is attached to the drive shaft to convert the rotation to the vertical motion, and the drive shafts move the slide plate up and/or down by the rotation of the servo motor.

Each of displacement measuring devices 80 is provided near each of the engaging portions 72. A magnetic scale 81 of the displacement measuring device 80 is mounted on the reference plate 90', and a magnetic sensor 82 of the displacement measuring device is supported at a support frame mounted on each of the engaging portions 72. Here, the reference plate 90' is held at the same position regardless of displacement of the slide plate 40. When the slide plate 40 is driven by the driving sources 70, the displacement of each of the engaging portions can be measured by the displacement measuring device 80.

As the forming proceeds, the forces working on the slide plate change as in FIGS. 7A, 7B and 7C explained above. With the change, the load onto the driving sources 70 changes. The positional relationship between each region of the movable die corresponding to each of the driving sources and the stationary die is not uniform. Some of them press down the slide plate 40 fast, and others slowly descend to press down the slide surface 40. The lead and the delay of each of the driving sources are measured by the displacement measuring devices 80, then they are sent to a control, and a drive pulse signal to each of the driving sources 70 is adjusted so that the displacement measured by each of the displacement measuring devices 80 becomes a desired value, namely, all the regions of the engaging portions on the slide plate become, for example, horizontal to each other.

Since the slide plate can descend while keeping the preferable positional relationship with respect to the lower support stand, according to the press forming machine explained here, uniform forming is made possible even when the location on which a reaction force is applied from a work piece changes during forming.

However, as shown by the dashed line in FIG. 5, deformation of the slide plate varies according to location. When the location at which the displacement measuring device is mounted is away from the portion where the drive shaft of the drive source engages with the slide plate, the displacement of the slide plate which should be measured at the location of the drive shaft is measured at the position in which the displacement measuring device is mounted, that is away from the location of the drive shaft. Consequently, the displacement of the slide plate measured by the displacement measuring device does not sometimes express the real displacements of the slide plate portions with which the drive shafts engage.

DISCLOSURE OF THE INVENTION

Consequently, it is an object of the present invention to provide a press forming machine including displacement measuring devices capable of accurately measuring displacements of slide plate portions with which drive shafts of the driving sources engage.

In a press forming machine comprising:

a lower support stand;

an upper support plate held by a plurality of support pillars supported at the lower support stand;

a slide plate capable of reciprocating between the lower support stand and the upper support plate and having a forming space between the lower support stand and the slide plate;

a plurality of driving sources each having a drive shaft for displacing the slide plate by engaging with the slide plate, and held by the upper support plate; and displacement measuring devices for measuring displacement of the slide plate, the press forming machine of the present invention comprises a reference plate for providing a displacement reference for the slide plate, which is supported on the lower support stand;

wherein the drive shaft has a through hole axially extending in a shaft center thereof, and the displacement measuring devices each measures, with respect to the reference plate, displacement of a portion of the slide plate, the portion corresponding to the through hole provided in the drive shaft.

In the press forming machine according to the present invention, it is preferable that the displacement measuring devices each comprises a displacement detecting shaft inserted into the through hole provided in the drive shaft to be able to move independently of the drive shaft, and a linear scale fixedly mounted on the reference plate; wherein one end of the displacement detecting shaft is fixed to the portion of the slide plate, corresponding to the through hole provided in the drive shaft, and the other end of the displacement detecting shaft extends beyond the reference plate to face the linear scale.

In the press forming machine of the present invention, the displacement measuring device is an optical displacement measuring device, and each of the optical displacement measuring devices is provided at a portion of the reference plate, which faces an end opening of the through hole provided in the drive shaft, to measure displacement of the portion of the slide plate, which faces the end opening of the through hole provided in the drive shaft,.

BEST MODE FOR CARRYING OUT THE INVENTION

Figure 1:
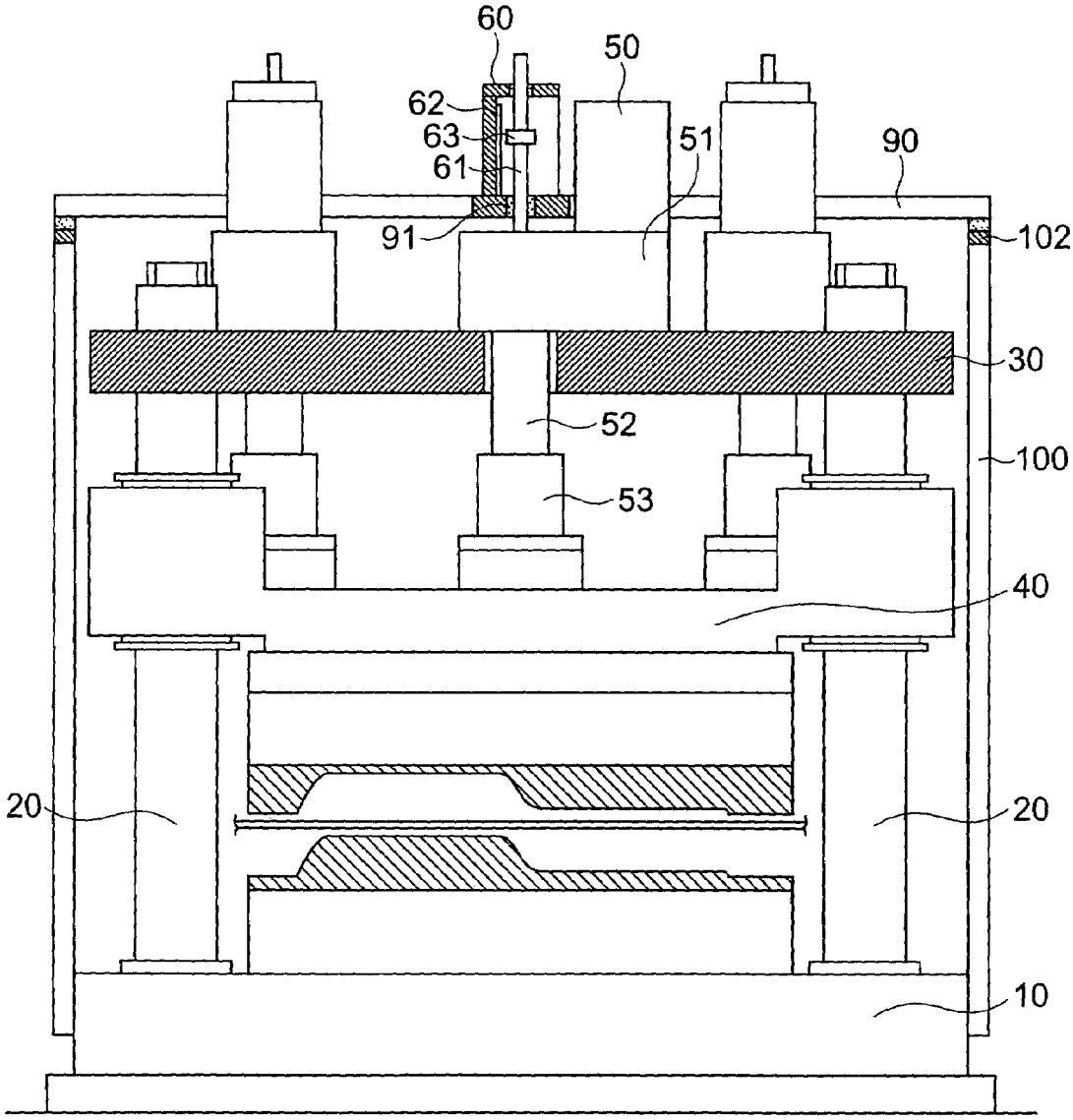
FIG. 1 is a partially sectional front view showing a press forming machine according to the present invention.
Figure 2A:
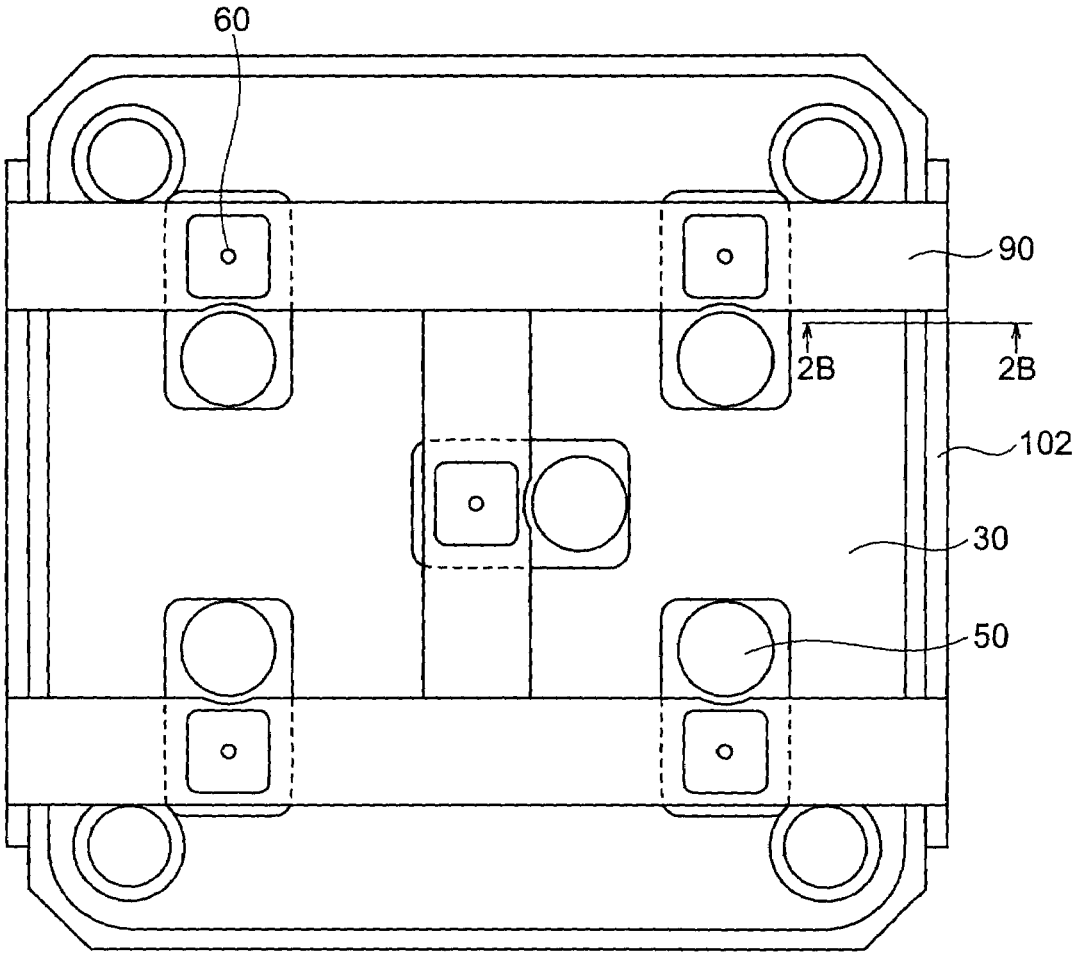
FIG. 2A is a plan view of the press forming machine of FIG. 1 according to the present invention.
Figure 3:
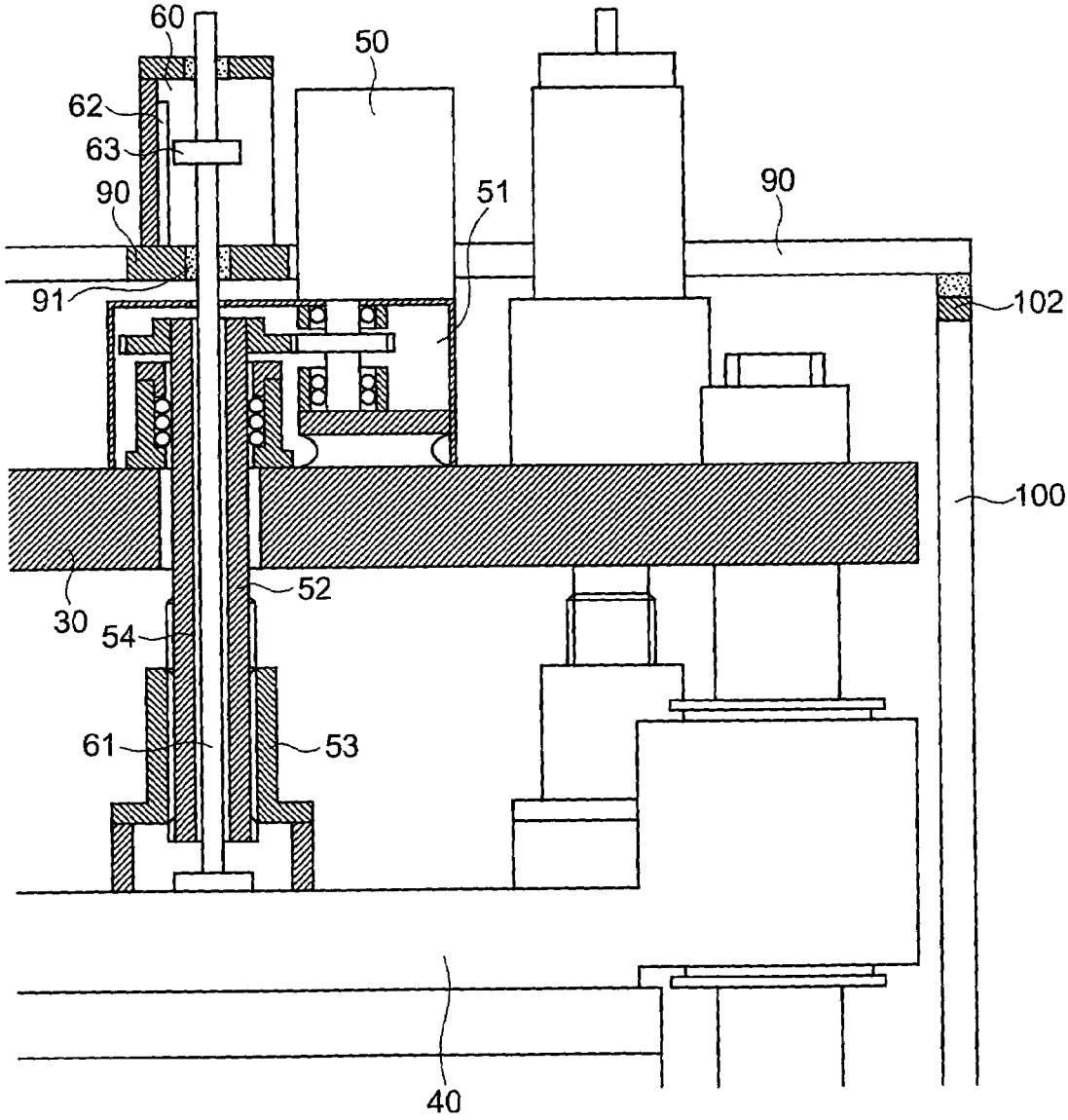
FIG. 3 is an enlarged, partially sectional view of a displacement measuring device shown in FIG. 1.
Figure 4:
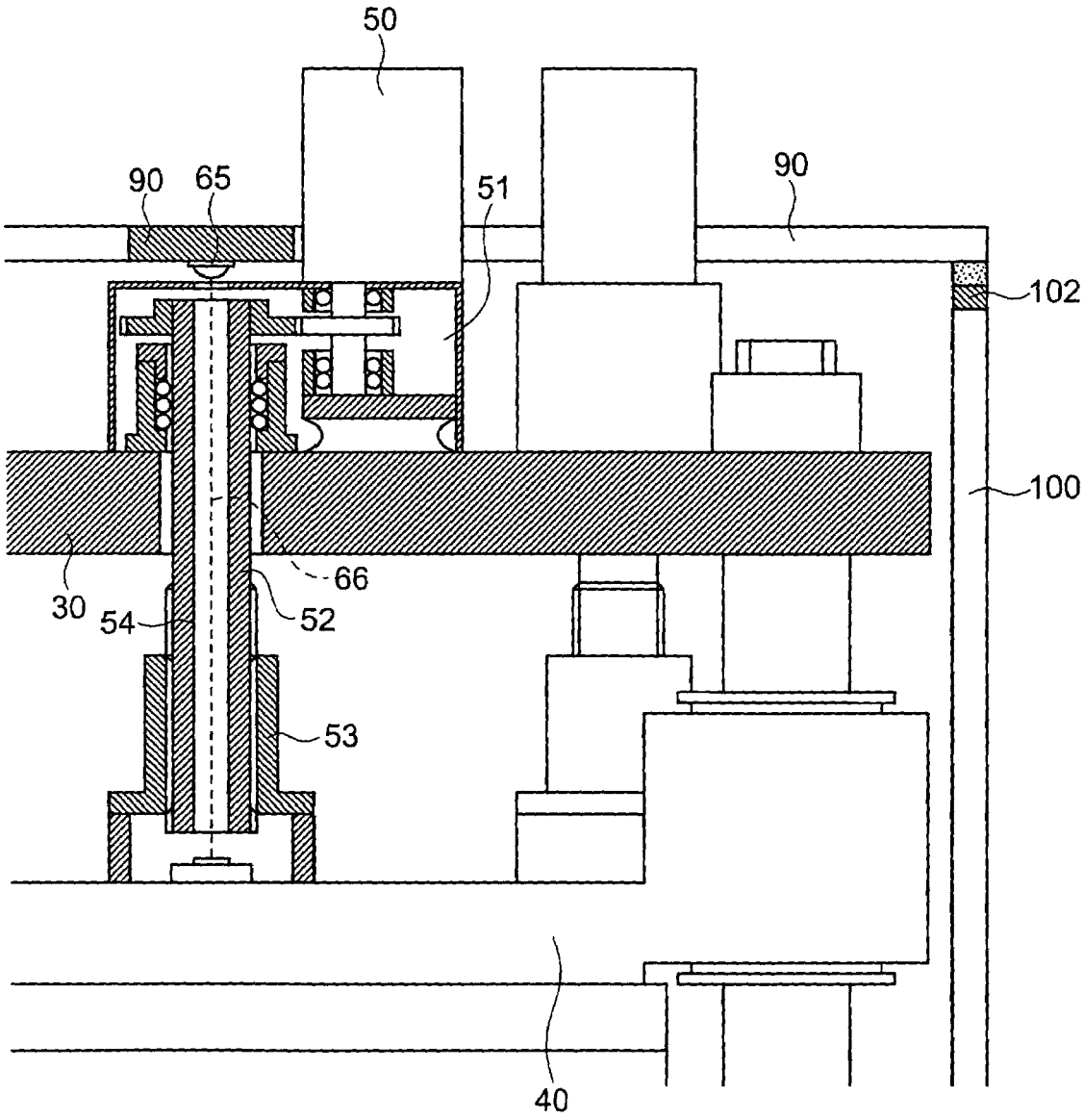
FIG. 4 is an enlarged sectional view of another embodiment of a displacement measuring device used in the press forming machine of the present invention.
Figure 5:
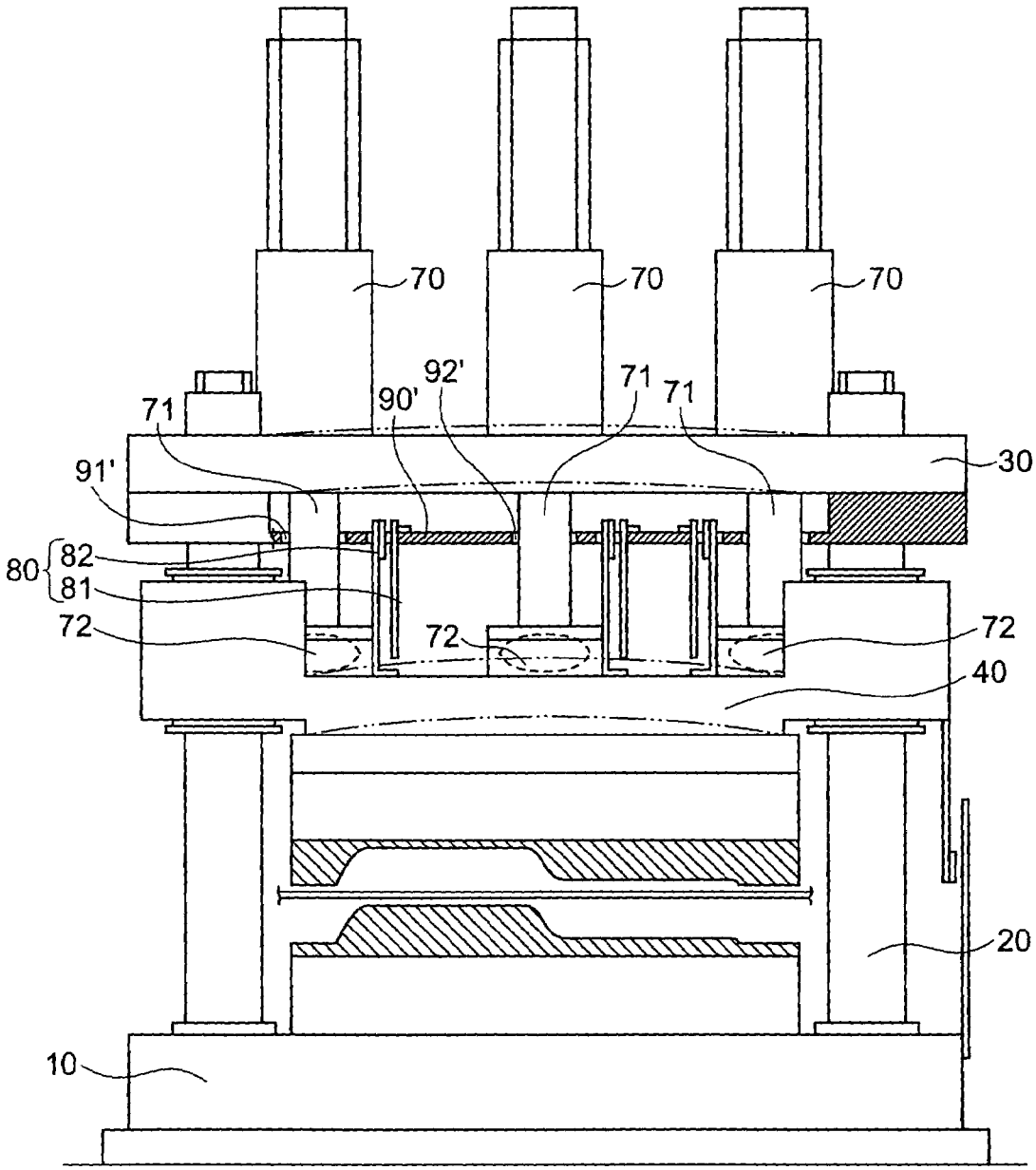
FIG. 5 is a front view of a press forming machine which the inventors proposed previously.
Figure 6:
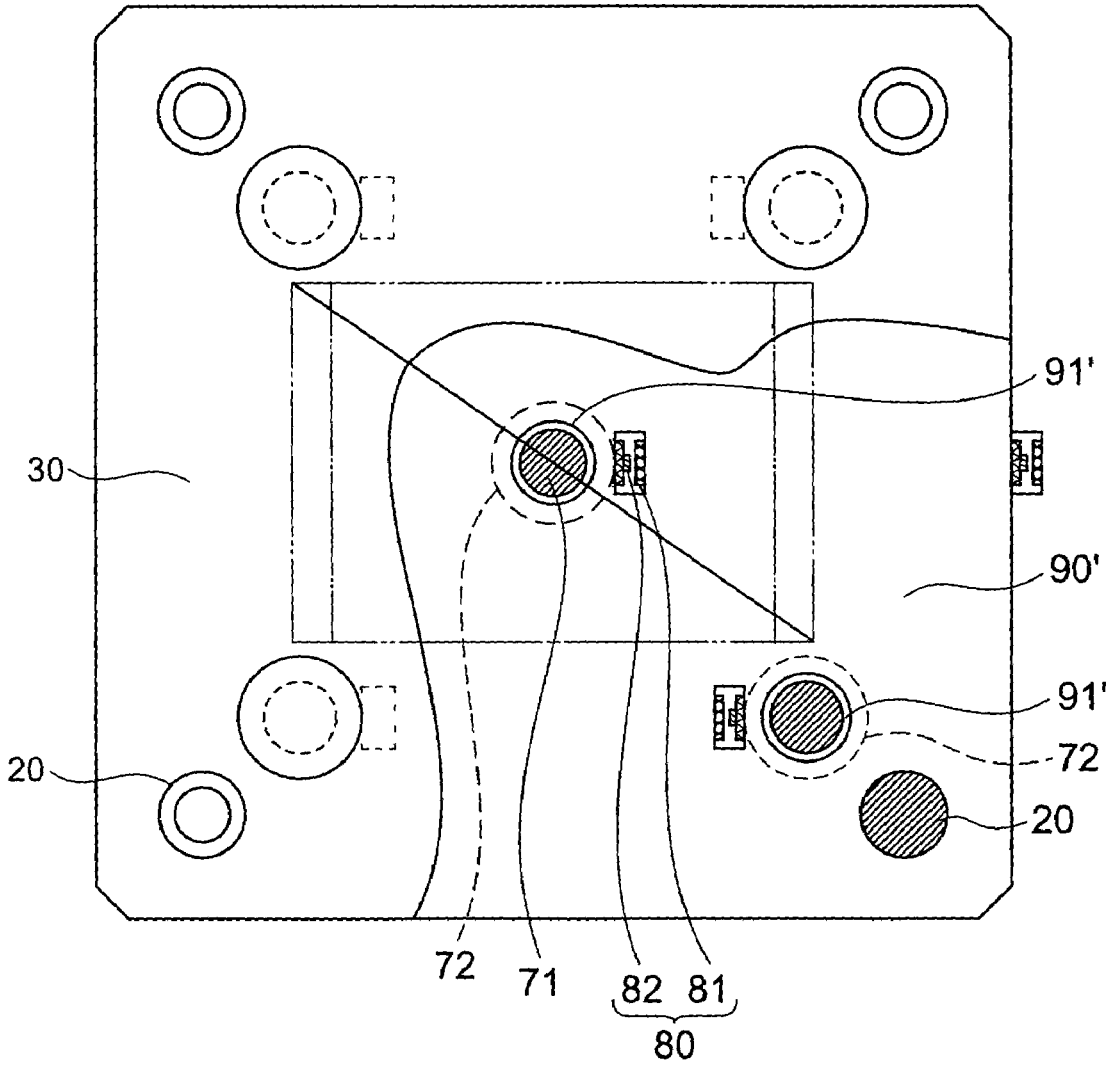
FIG. 6 is a plan view of the press forming machine shown in FIG. 5.
Figure 7A:
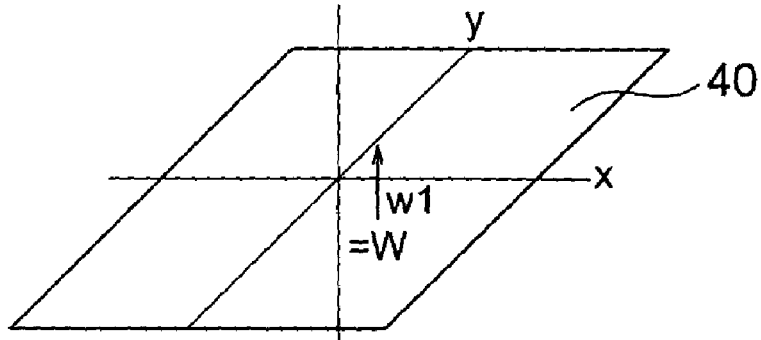
FIGS. 7A, 7B and 7C are schematic views for explaining changes in loads following the proceeding of press forming.
Figure 7B:
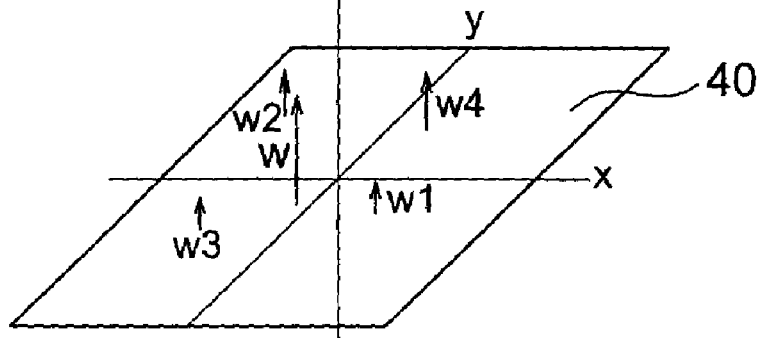
Figure 7C:
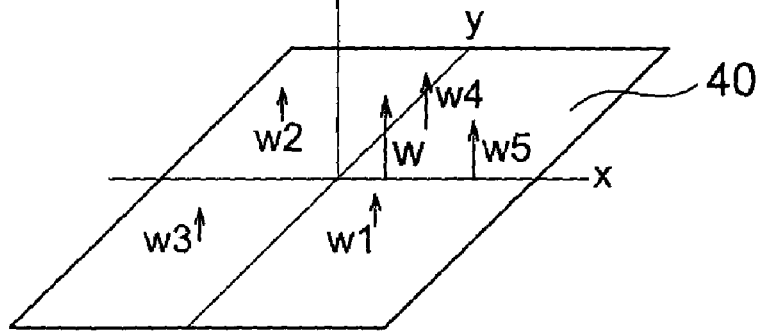

A press forming machine of the present invention will be explained hereinafter with reference to the drawings. FIG. 1 is a front view of the press forming machine, FIG. 2A is a plan view thereof, FIG. 3 shows an enlarged, partially sectional view of a displacement measuring device shown in FIG. 1, and FIG. 4 shows in section a displacement measuring device according to another embodiment of the invention. In these drawings, the same parts as in FIGS. 5 and 6 are shown by using the same reference numerals and characters.

The press forming machine has a lower support stand 10 fixed on a floor surface, and an upper support plate 30 is held by support pillars 20 placed upright on the lower support stand. A slide plate 40 capable of reciprocating along the support pillars 20 is provided between the lower support stand 10 and the upper support plate 30, and a forming space is provided between the slide plate and the lower support stand. In the forming space, a stationary die (lower die) for pressing is mounted on the lower support stand, while a movable die (upper die) corresponding to the stationary die is mounted on an undersurface of the slide plate, and for example, a plate to be formed is placed between the both dies and formed.

Five components each combining a servo motor with a speed reduction mechanism are mounted on the upper support plate 30 as drive sources 50. Each drive shaft 52 from each of the drive sources via a gear box 51 having the speed reduction mechanism inside passes through a through-hole provided in the upper support plate 30 to engage with an engaging portion 53 on a top surface of the slide plate 40. The inside surface of the engaging portion engages with the drive shaft, for example, through a ball screw, to convert the rotation of the drive shaft into vertical movement, and to move the slide plate up and/or down by the rotation of the servo motor. Since a rotation shaft of the servo motor and the drive shaft are engaged with each other by the speed reduction mechanism such as a speed reduction gear, the axes of them are at the position deviated from each other, and thus the servo motor is located to be deviated from the axis of the drive shaft.

When a plurality of driving sources are used as described above, it is preferable that the driving sources are disposed so that the pressing pressure to the slide plate by a plurality of the driving sources is uniformly distributed on the slide plate. It is preferable that the driving sources generate the pressing pressure of the same magnitude as each other, namely, their output powers are the same.

Figure 2B:
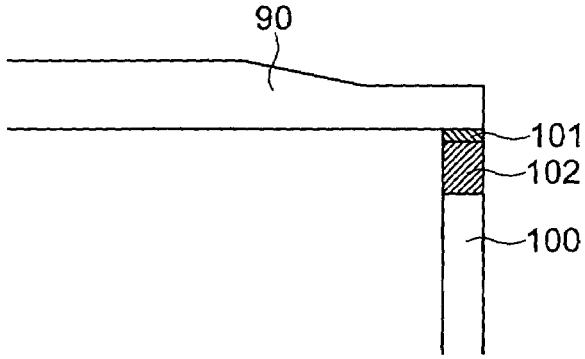
FIG. 2B is a sectional view taken along the line of 2B-2B in FIG. 2A.

A reference plate 90 is constructed, for example, by an H-shaped titanium frame body, and is supported by a support frame 100 fixed on the lower support stand 10 and connecting bars 102 supported by the support pillars. Except that the reference plate 90 is held on the lower support stand 10, the reference plate 90 is not in contact with any portion of the press forming machine, or is not affected by the press forming machine during press forming, and therefore the reference plate 90 is independent of the deformation of each portion of the press forming machine during press forming. The reference plate 90 is shown in FIG. 2B taken along the line 2B—2B in FIG. 2A, and as in this drawing, it is preferable that the reference plate 90 is mounted on the connecting bar 102 supported at the support pillar 100 via a vibration isolating plate 101. It is preferable to use a material such as Invar, which is less affected by heat, for the support pillar 100 and the connecting bar 102.

A through hole 54 is axially provided in the shaft center of each of the drive shafts 52, and a displacement detecting shaft 61 of the displacement measuring device 60 is fixed on a slide plate portion corresponding to the through hole or facing an end opening of the through hole. The displacement detecting shaft 61 can move freely in the through hole with respect to the drive shaft 52. When the slide plate 40 moves up and/or down, the displacement detecting shaft 61 mounted is also moved up and/or down with respect to the slide plate 40. The other end of the displacement detecting shaft 61 protrudes till an upper portion of the drive shaft 52 from the through hole 54 provided in the drive shaft 52 to extend upward from the reference plate or from a bush 91 having a through hole, which is provided in the reference plate 90, and the other end of the displacement detecting shaft is slidably held by the bush 91. It is preferable that the displacement detecting shaft 61 is also slidably held by another bush at an upper portion of the displacement measuring device. An upper portion of the displacement detecting shaft 61 faces a linear scale 62 fixedly mounted on the reference plate 90. When, for example, a magnetic scale is used as the linear scale 62, and for example, a magnetic sensor 63 is mounted on the upper portion of the displacement detecting shaft, the magnetic sensor moves with respect to the linear scale corresponding to the displacement of the portion of the slide plate, facing the end opening of the through hole provided in the drive shaft, and therefore the displacement of the slide shaft can be measured. The displacement detecting shaft measures the displacement of the slide plate at the shaft center of the drive shaft, and therefore the displacement of the slide plate by the drive shaft is detected.

FIG. 4 shows another embodiment of the displacement measuring device in a sectional view. Here, the through hole 54 is also axially provided in the shaft center of the drive shaft 52, but an optical displacement measuring device 65 is provided at a portion of the reference plate 90, which faces an end opening of the through hole provided in the drive shaft. A light beam 66 emitted from the optical displacement measuring device 65 is reflected at the portion of the slide plate 40, which faces the end opening of the through hole provided in the drive shaft, and the distance to that portion is measured.

In the embodiment of the present invention shown in FIGS. 1 through 4, the axes of the driving source 50 and the drive shaft 52 are displaced from each other and the speed change mechanism is provided therebetween, but the rotation shaft of the servo motor of the driving source 50 and the drive shaft are integrated, and a through hole extending till an upper portion of the servo motor can be provided in the shaft center thereof. The displacement detecting shaft extending till the upper portion of the servo motor is provided in the through hole, and the reference plate is provided at the upper portion of the servo motor, where the displacement measuring device can be provided.

INDUSTRIAL APPLICABILITY

As explained above in detail, in the press forming machine of the present invention, the displacement of the slide plate can be measured in the centers of the drive shafts for driving the slide plate of the press forming machine. As a result, when the driving sources are controlled in accordance with the displacement of the slide plate, the displacements of the slide plate is measured at the pressurized points, and therefore the control can be made accurately.

What is claimed is:

1. A press forming machine comprising:

a lower support stand;

an upper support plate held by a plurality of support pillars supported at the lower support stand;

a slide plate capable of reciprocating between the lower support stand and the upper support plate and having a forming space between the lower support stand and the slide plate;

driving sources each having a drive shaft for displacing the slide plate by engaging with the slide plate, and held by the upper support plate; and displacement measuring devices for measuring displacement of the slide plate;

wherein the lower support stand supports a reference plate that is a displacement reference for the slide plate;

the drive shaft has a through hole axially extending in a shaft center thereof; and the displacement measuring devices each measures, with respect to the reference plate, displacement of a portion of the slide plate, the portion corresponding to the through hole provided in the drive shaft.

2. The press forming machine according to claim 1, wherein the displacement measuring devices each comprises:

a displacement detecting shaft inserted into the through hole provided in the drive shaft to be able to move independently of the drive shaft; and a linear scale fixedly mounted on the reference plate; and wherein one end of the displacement detecting shaft is fixed to the portion of the slide plate, corresponding to the through hole provided in the drive shaft, and the other end of the displacement detecting shaft extends above the reference plate to face the linear scale.

3. The press forming machine according to claim 1, wherein the displacement measuring device is an optical displacement measuring device;

each of the optical displacement measuring devices is provided at a portion of the reference plate, the portion facing an end opening of the through hole provided in the drive shaft, to measure displacement of the portion of the slide plate.

* * * * *